US007857665B2

(12) United States Patent
Xiong et al.

(10) Patent No.: US 7,857,665 B2
(45) Date of Patent: Dec. 28, 2010

(54) ELECTRICAL CONNECTOR WITH IMPROVED CONTACT ARRANGEMENT

(75) Inventors: Feng Xiong, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/471,501

(22) Filed: May 26, 2009

(65) Prior Publication Data

US 2009/0298336 A1 Dec. 3, 2009

(30) Foreign Application Priority Data

May 29, 2008 (CN) ..... 2008 2 0037490

(51) Int. Cl.
*H01R 13/648* (2006.01)

(52) U.S. Cl. ..... 439/660; 439/79

(58) Field of Classification Search ..... 439/660, 439/79

See application file for complete search history.

(56) References Cited

U.S. PATENT DOCUMENTS 5,186,633 A * 2/1993 Mosser, III ..... 439/79
6,250,957 B1 * 6/2001 Chang ..... 439/541.5
6,431,882 B1 * 8/2002 Noda et al. ..... 439/79
6,986,681 B2 1/2006 Tsai
7,086,901 B2 * 8/2006 Zhang ..... 439/607.56
7,497,739 B2 * 3/2009 Zhang et al. ..... 439/638
7,591,683 B2 * 9/2009 Zhang et al. ..... 439/638
2007/0066115 A1 * 3/2007 Saito et al. ..... 439/260
2009/0111330 A1 * 4/2009 Lin et al. ..... 439/638
2009/0298351 A1 * 12/2009 Xiong et al. ..... 439/676

FOREIGN PATENT DOCUMENTS

JP 2007-115707 5/2007

OTHER PUBLICATIONS

VESA DisplayPort Standard, Version 1, Revision 1a, Jan. 11, 2008, pp. 201-205.

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector includes an insulative housing, a set of first contacts retained in the insulative housing and a metal shell. The insulative housing includes a tongue plate with a plurality of first passageways defined thereon. The first contacts include first contacting sections received in the first passageways, first bending sections and first tail sections. The first bending sections include a plurality of first offset sections and at least one second offset section. A first slope of each first offset section is of negative number while a second slope of the second offset section is of positive number so that a space between each adjacent two first tail sections is much larger than that of the corresponding first contacting sections for easily soldering of the first tail sections.

19 Claims, 8 Drawing Sheets

ELECTRICAL CONNECTOR WITH IMPROVED CONTACT ARRANGEMENT

BACKGROUND OF THE INVENTION

1. Field of the Invention

This invention generally relates to an electrical connector, and more particularly to an electrical connector with improved contact arrangement for preventing soldering confusion.

2. Description of Related Art

Japanese unexamined publication No. 2007-115707 discloses an electrical connector includes an insulative housing and a plurality of contacts retained in the insulative housing. The insulative housing includes a horizontal tongue portion defining a plurality of upper and lower passageways. The contacts include horizontal portions and tail portions bending from the horizontal portions. Each horizontal portion includes a contact portion received in the corresponding passageway. Some horizontal portions include corresponding offset portions extending sidewardly and outwardly from the contact portions so that a pitch between the adjacent two tail portions can be enlarged. However, since the offset portions are set on the horizontal portions, which will weak the structure of the horizontal portions. In assembly, the horizontal portions may easily be deformable to reduce assembly efficiency of the contacts.

Hence, it is desired to have an electrical connector with improved contact arrangement to solve the problems above.

BRIEF SUMMARY OF THE INVENTION

An electrical connector defining a receiving space for accommodating a corresponding connector includes an insulative housing, a set of first contacts retained in the insulative housing and a metal shell fixed to the insulative housing. The insulative housing includes a base portion and a tongue plate protruding from the base portion into the receiving space. A number of first passageways are defined on a first surface of the tongue plate. The first contacts include first contacting sections received in the first passageways, first bending sections downwardly extending from the first contacting sections and first tail sections extending from the first bending sections. The first contacting sections are arranged in a single row and distributed essentially evenly over the first surface. The first bending sections include a plurality of first offset sections and at least one second offset section. The metal shell is fixed to the base portion and encloses the tongue plate. A first slope of each first offset section is of one of the positive and negative numbers while a second slope of the second offset section is of the rest of the positive and negative numbers so that a space between each adjacent two first tail sections is much larger than that of the corresponding first contacting sections for easily soldering of the first tail sections. As a result soldering confusion of the first tail sections is avoided.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
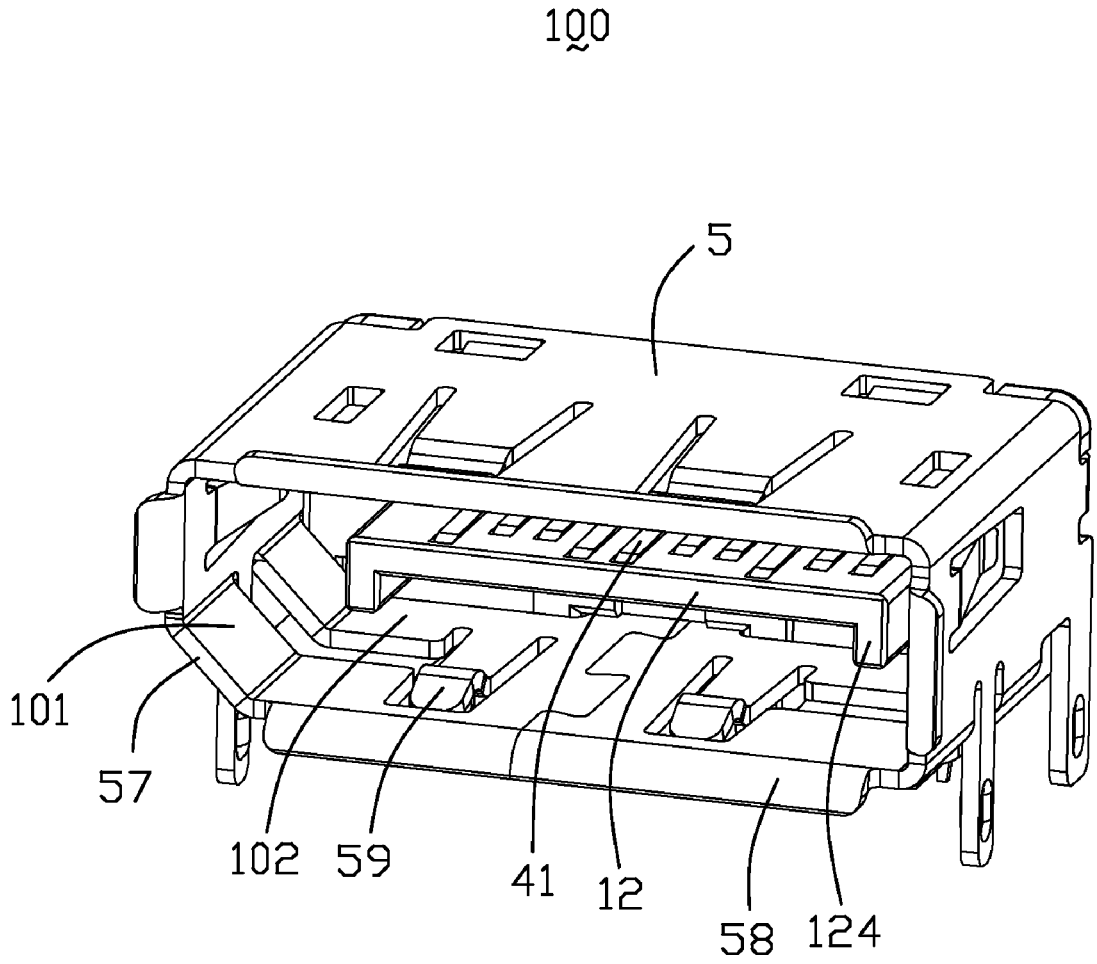
FIG. 1 is a perspective view of an electrical connector according to a preferred embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1 to 6, an electrical connector 100 according to a preferred embodiment of present invention is disclosed. The electrical connector 100 includes a mating surface 101 and a receiving space 102 recessed from the mating surface 101 for accommodating a corresponding connector (not shown). The electrical connector 100 includes an insulative housing 1, a plurality of contacts 4 retained in the insulative housing 1, a spacer 2 mounted at a rear of the insulative housing 1 for organizing the contacts 4, a meal shell 5 enclosing the insulative housing 1 and a rear shell 3 attached to the metal shell 5.

Figure 5:
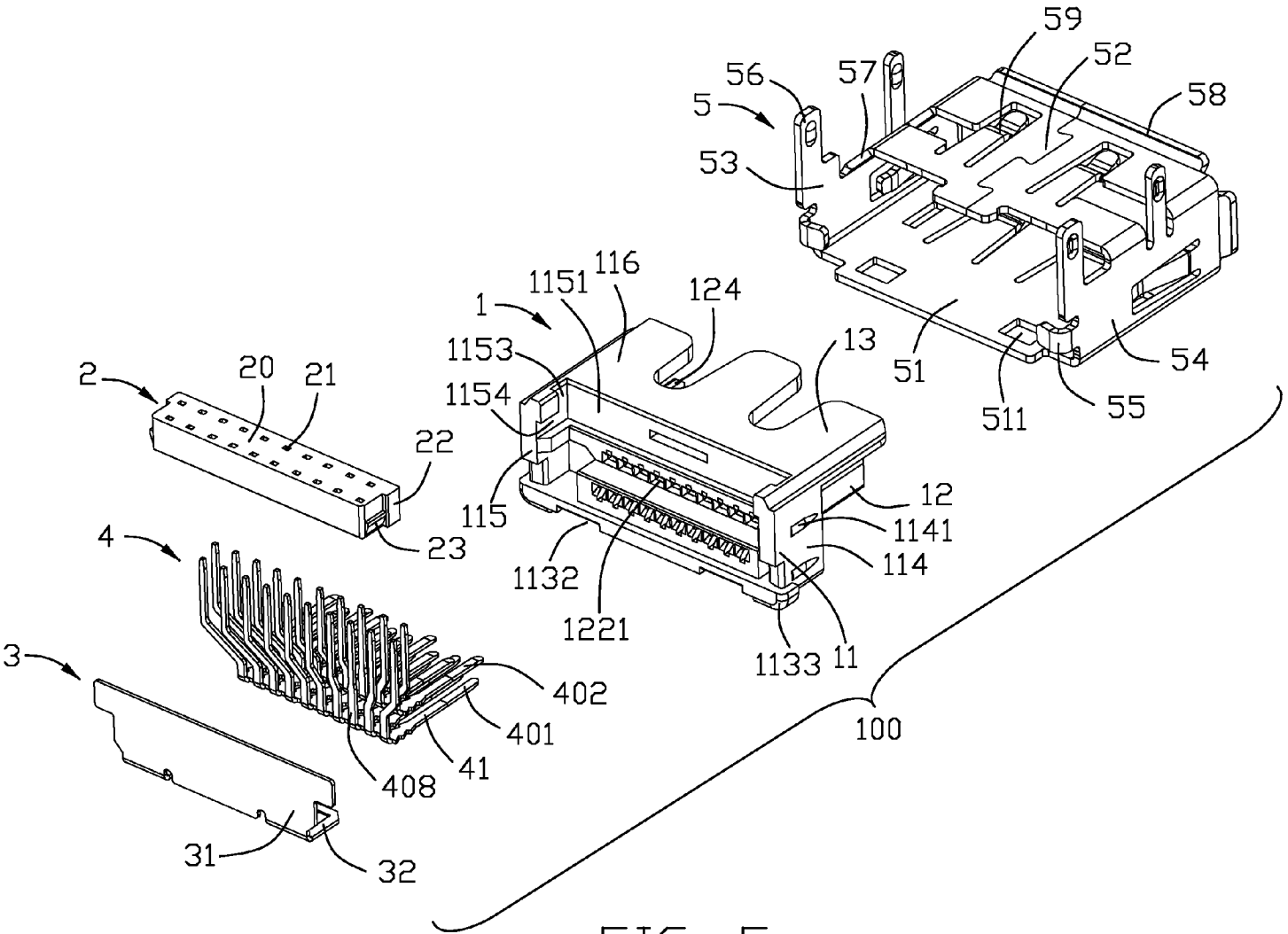
FIG. 5 is an exploded view of the electrical connector shown in FIG. 1.
Figure 6:
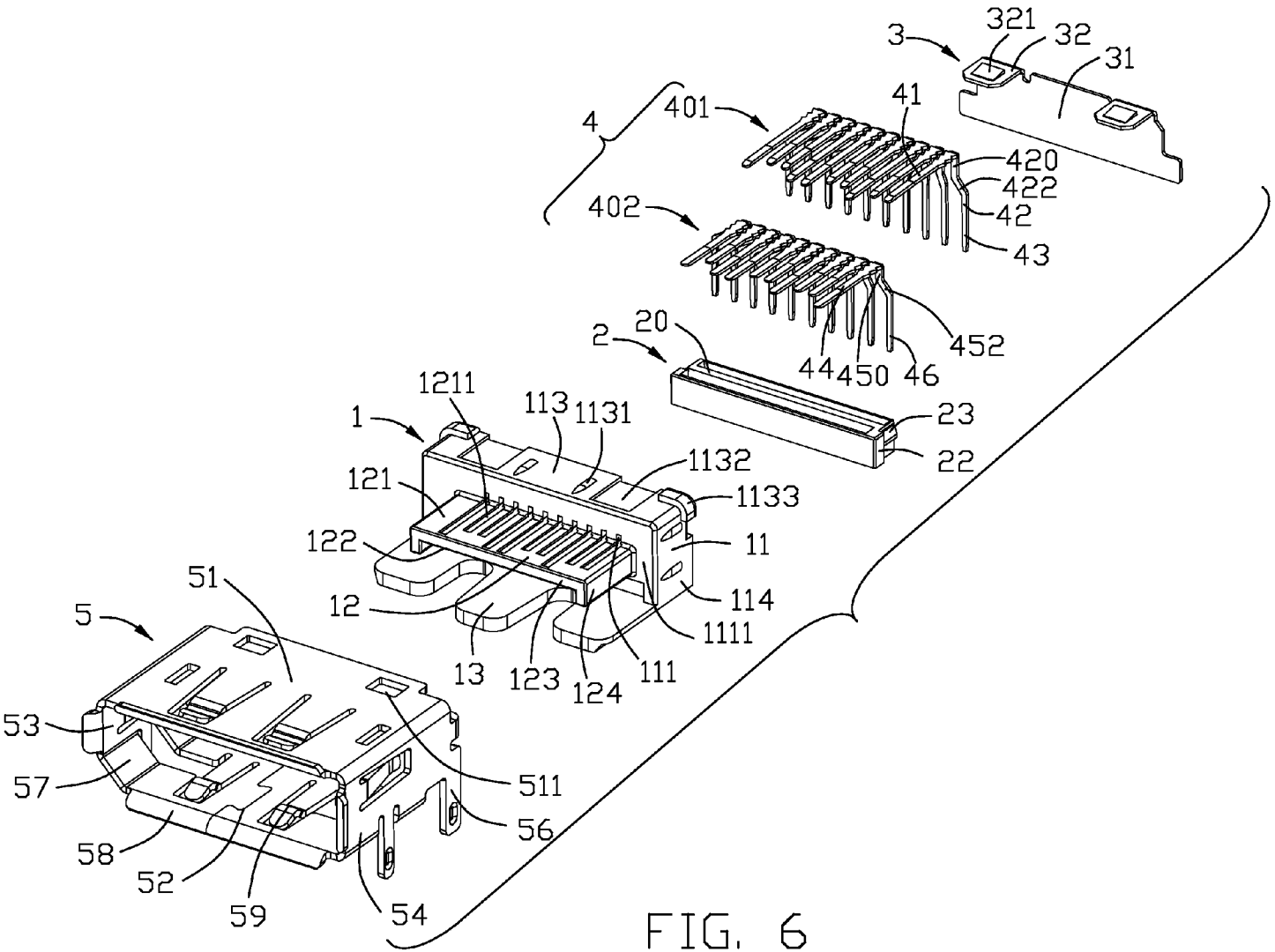
FIG. 6 is another exploded view of the electrical connector, while taking from another aspect.

Referring to FIGS. 5 & 6, the insulative housing 1 includes a rectangular base 11, a tongue plate 12 extending forwardly from a front surface 111 of the base 11 and a bottom plate 13 below the tongue plate 12. The base 11 includes a rear surface 115 opposite to the front surface 111, a top surface 113, a bottom surface 116 and a pair of side surfaces 114. The base 11 defines a receiving chamber 1151 through the rear surface 115 for receiving the spacer 2, a vertical slot 1153 and a horizontal slot 1154 both in communication with the receiving chamber 1151. The vertical slot 1153 and the horizontal slot 1154 extend through the bottom surface 116 and the rear surface 115, respectively. A pair of ribs 1131 are formed on a middle portion of the top surface 113 for abutting against the metal shell 5. A pair of depressions 1132 are defined through the top surface 113 and are located at lateral sides of the ribs 1131. A pair of resisting blocks 1133 are formed at the rear surface 115 and further extend beyond the side surfaces 114. In order to firmly fix the metal shell 5 on the insulative housing 1, each side surface 114 includes at least one protrusion 1141 for abutting against the metal shell 5. The tongue plate 12 is substantially reverse U-shaped and includes a horizontal main portion 123 and a pair of vertical tabs 124 extending downwardly from lateral sides of the main portion 123. The main portion 123 includes a top wall 121 defining a plurality of first passageways 1211 and a bottom wall 122 defining a plurality of second passageways 1221 for jointly receiving the contacts 4. The pair of vertical tabs 124 are adapted for preventing error insertion of other connectors.

The spacer 2 includes a vertical extension 22 and a horizontal extension 23 received in the vertical slot 1153 and the horizontal slot 1154, respectively. A plurality of through holes 21 are formed extending through the opposite surfaces 20 for the contacts extending therethrough.

Figure 2:
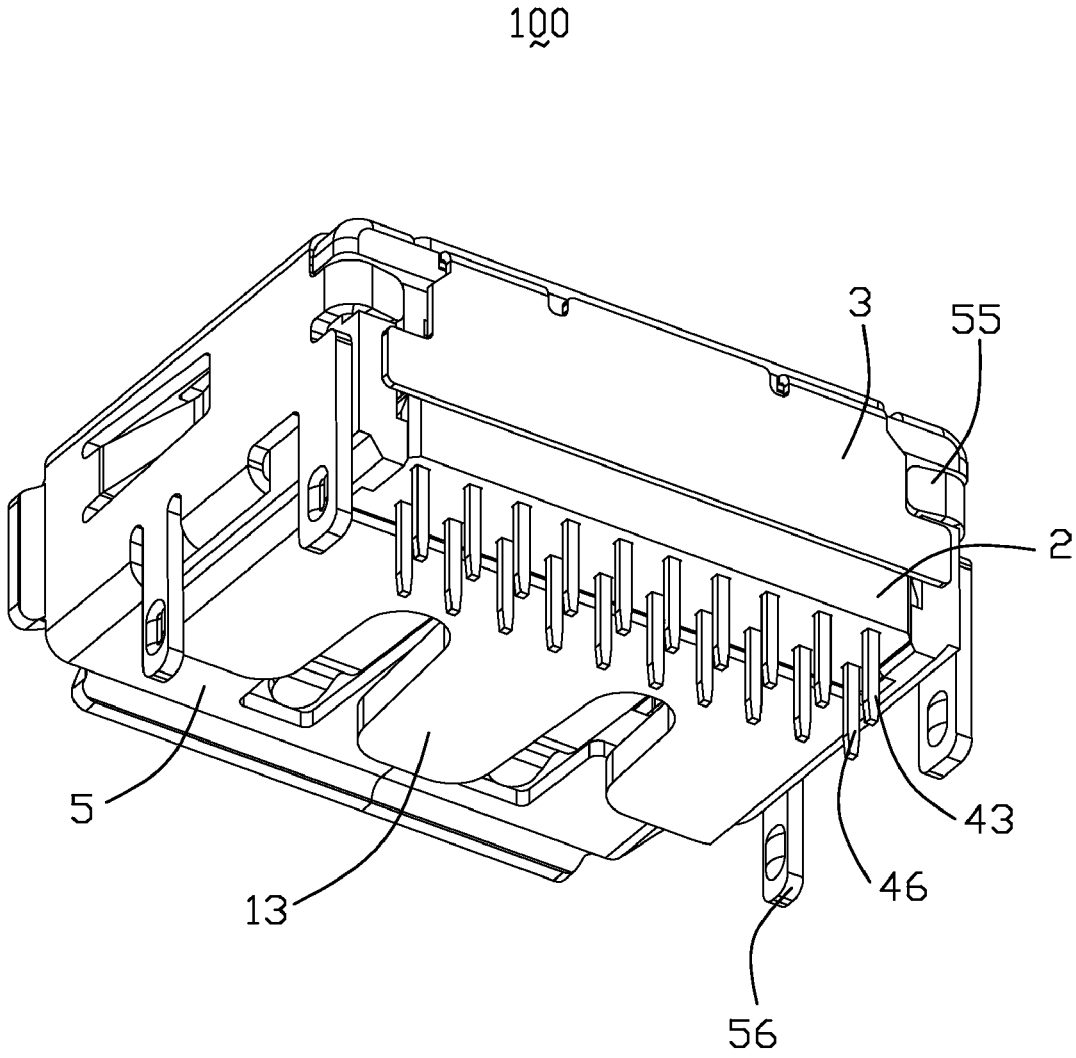
FIG. 2 is another perspective view of the electrical connector, but viewed from another aspect.

Referring to FIGS. 2 & 6, the rear shell 3 includes a flat body 31 shielding the receiving chamber 1151, a pair of fastening portions 32 received in the depressions 1132 for positioning purpose and a projection 321 formed on each fastening portion 32.

The metal shell 5 includes a top wall 51 abutting against the top surface 113 of the insulative housing 1, a bottom wall 52 opposite to the top wall 51 and a pair of side walls 53, 54 connecting the top and bottom walls 51, 52. Each top, bottom or side wall 53, 54 includes at least one engaging arm 59 extending into the receiving space 102 for abutting against the corresponding connector. A pair of outward lips 58 are formed on the top and the bottom walls 51, 52 for guiding insertion of the corresponding connector. Besides, a slant wall 57 is formed connecting one of the side wall 53, 54 and the bottom wall 52 for guiding right insertion of the corresponding connector. The top wall 51 defines a pair of through holes 511 for abutting against the projections 321 of the rear shell 3. The bottom wall 52 includes a pair of board locks 56 extending through a PCB on which the electrical connector 100 is mounted. The top wall 51 and the pair of side walls 53, 54 resist against the resisting blocks 1133 for fixation. A pair of hooks 55 are bended inwardly from side walls 53, 54 for locking with the rear surface 115 of the insulative housing 1 so that the metal shell 5 can be stably fixed to the insulative housing 1.

Figure 7:
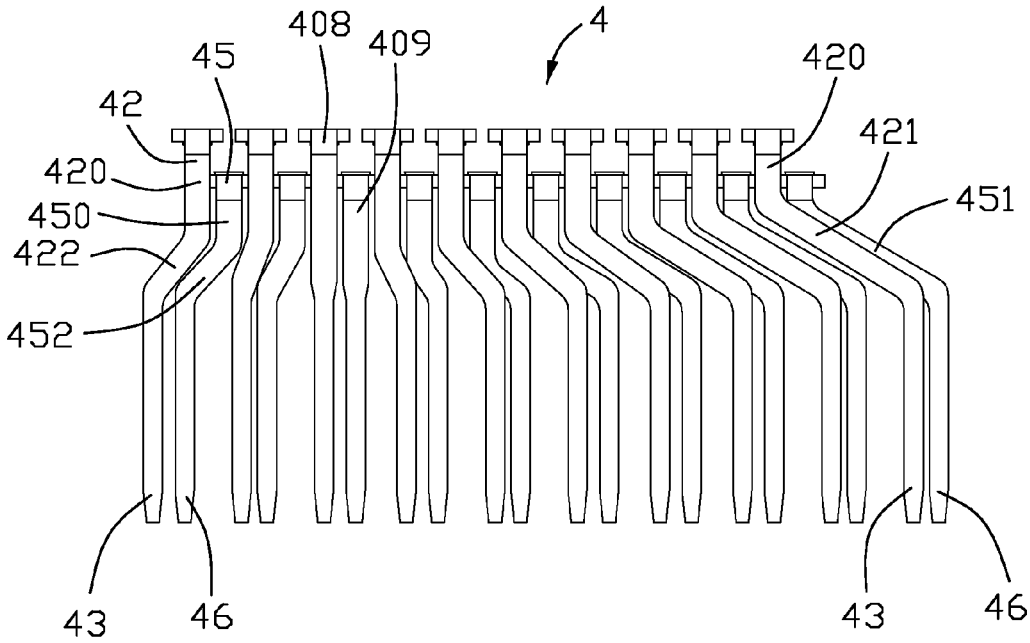
FIG. 7 is a rear view of first and second contacts shown in FIG. 5.
Figure 8:
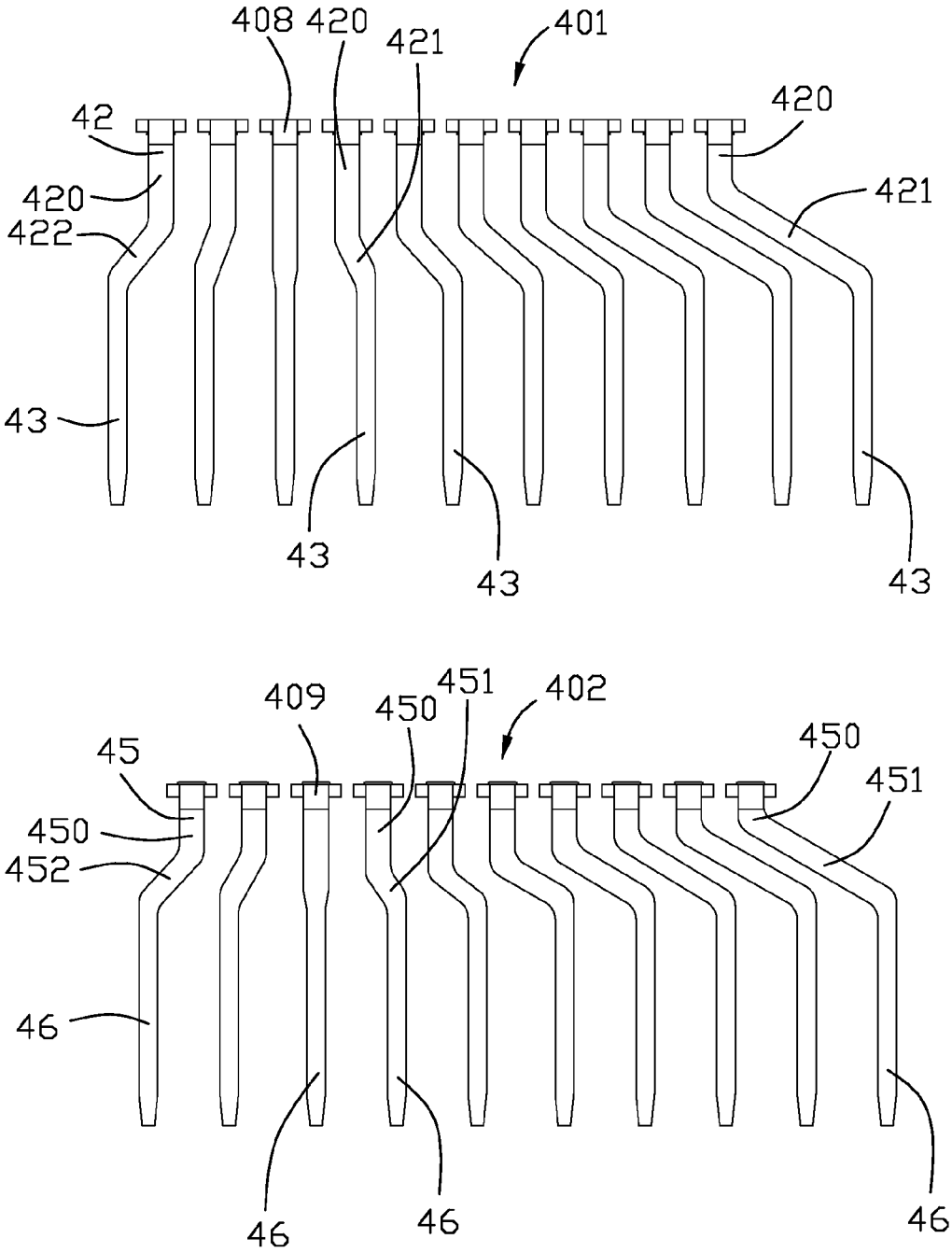
FIG. 8 is a rear view of the separated first and second contacts shown in FIG. 7.

Referring to FIGS. 7 to 8, the contacts 4 are stamped from metal sheets and includes a plurality of outward first contact 401 and a plurality of inward second contact 402. The first contacts 401 include first contacting sections 41, first bending sections 42 extending downwardly from rear edges the first contacting sections 41 and contracted first tail sections 43 extending downwardly from the first bending sections 42. All the first contacting sections 41 are arranged in a single row and are received in the first passageways 1211. Besides, the first contacting sections 41 are distributed essentially evenly over the top wall 121 and exposed to the receiving space 102. The first contacts 401 only include one first alignment contact 408 with its first tail section 43 in align with its first contacting section 41. The rest of the first contacts 401 are arranged with their first tail sections 43 offsetting from the corresponding first contacting sections 41 as best shown in FIG. 8. The first bending sections 42 include first vertical sections 420 bending downwardly from the rear edges of the first contacting sections 41, a plurality of first offset sections 421 extending sidewardly and outwardly from the corresponding first vertical sections 420 and a plurality of second offset sections 422 extending sidewardly and outwardly from the corresponding first vertical sections 420. The first tail sections 43 are parallel to the first vertical sections 420. As shown in FIGS. 7 & 8, the first offset sections 421 are located at a right side of the first alignment contact 408 and the second offset sections 422 are located at a left side of the first alignment contact 408. A space between each adjacent two first tail sections 43 is much larger than that of the corresponding first contacting sections 41 for preventing short circuit of first tail sections 43 during soldering process.

The following description is viewed under a condition that the electrical connector 100 is normally mounted on the PCB and is viewed from a rear-to-front direction. A first slope of each first offset section 421 is of negative number while a second slope of each second offset section 422 is of positive number. In detail, all the first slopes of the first offset sections 421 are different and gradually decrease in turn along a transverse direction from the second offset section 422 to the first offset section 421. All the second slopes of the second offset sections 422 which gradually decrease in turn along the transverse direction from the first offset section 421 to the second offset section 422. Height of the first vertical sections 420 located at the right side of the first alignment contact 408 gradually becomes short in turn along the transverse direction from the second offset section 422 to the first offset section 421. Besides, height of the first vertical sections 420 located at the left side of the first alignment contact 408 gradually becomes short in turn along the transverse direction from the first offset section 421 to the second offset section 422.

Figure 3:
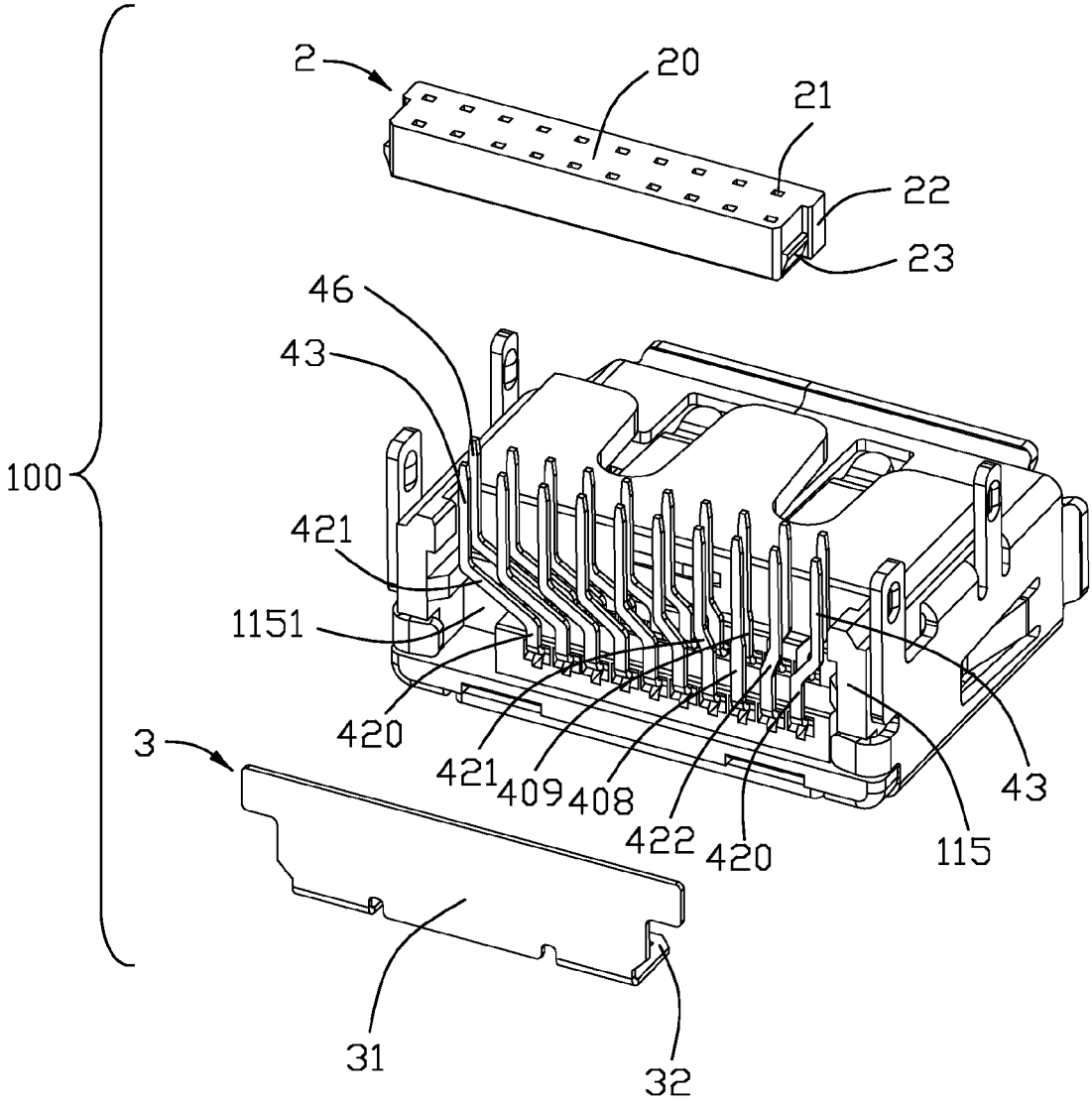
FIG. 3 is a part exploded view of the electrical connector with a spacer and a rear shell detaching therefrom.
Figure 4:
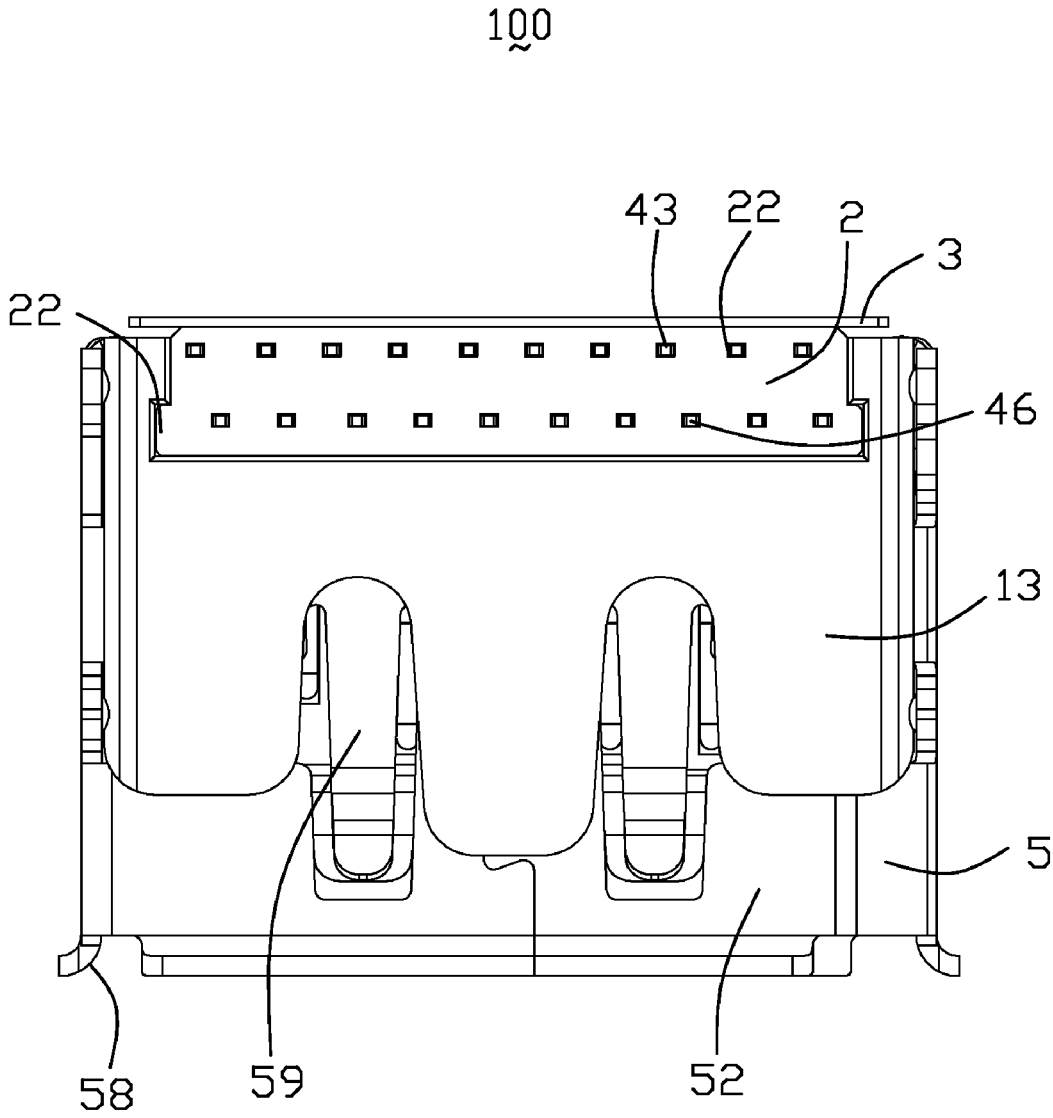
FIG. 4 is a bottom view of the electrical connector shown in FIG. 2.

The second contacts 402 are similar to the first contacts 401 and include second contacting sections 44, second bending sections 45 extending downwardly from the second contacting sections 44 and contracted second tail sections 46 extending downwardly from the second bending sections 45. All the second contacting sections 44 are arranged in another single row and are received in the second passageways 1221. Besides, the second contacting sections 44 are distributed evenly over the bottom wall 122 and exposed to the receiving space 102. The second contacts 402 only includes one second alignment contact 409 with its second tail section 46 in align with its second contacting section 44. The rest of the second contacts 402 are arranged with their second tail sections 46 offsetting from the corresponding second contacting sections 44 as shown in FIGS. 3 & 5. The second bending sections 45 include second vertical sections 450 bending downwardly from rear edges of the second contacting sections 44, a plurality of second offset sections 451 extending sidewardly from the corresponding second vertical sections 450 and a plurality of fourth offset sections 452 extending sidewardly from the corresponding second vertical sections 450. The second tail sections 46 are parallel to the second vertical sections 450. As shown in FIG. 3, the third offset sections 451 are located at a right side of the second alignment contact 409 and the fourth offset sections 452 are located at a left side of the second alignment contact 409. A space between each adjacent two second tail sections 46 is much larger than that of the corresponding second contacting sections 44 for preventing short circuit of second tail sections 46 during soldering process.

The following description is viewed under a condition that the electrical connector 100 is normally mounted on the PCB and is viewed from the rear-to-front direction. A third slope of each third offset section 451 is of negative number while a fourth slope of each fourth offset section 452 is of positive number. In detail, all the third slopes of the third offset sections 451 are different and gradually decrease in turn along the transverse direction from the fourth offset section 452 to the third offset section 451. All the fourth slopes of the fourth offset sections 452 which gradually decrease in turn along the transverse direction from the third offset section 451 to the fourth offset section 452. Height of the second vertical sections 450 located at the right side of the second alignment contact 409 gradually becomes short in turn along the transverse direction from the fourth offset section 452 to the third offset section 451. Height of the second vertical sections 450 located at the left side of the second alignment contact 409 gradually becomes short in turn along the transverse direction from the third offset section 451 to the fourth offset section 452.

The first and the second tail sections 43, 46 are respectively arranged in parallel first and second rows. Any first tail section 43 of the first row and any second tail section 46 of the second row offset from one another along a longitudinal direction perpendicular to the transverse direction. As a result, pitches between the adjacent first and second tail sections 43, 46 can be reasonably large enough for easily soldering. Besides, horizontal sections of the contacts 4 are linear so that the horizontal sections can be of reasonable strong structure for being easily inserted into the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector defining a receiving space for accommodating a corresponding connector, comprising:

an insulative housing having a base portion and a tongue plate protruding from the base portion into the receiving space, a plurality of first passageways being defined on a first surface of the tongue plate;

a set of first contacts comprising first contacting sections received in the first passageways, first bending sections downwardly extending from the first contacting sections, and first tail sections extending from the first bending sections, the first contacting sections being arranged in a single row and being distributed essentially evenly over the first surface, the first bending sections including a plurality of first offset sections and at least one second offset section, a space between each adjacent two first tail sections being much larger than that of the corresponding first contacting sections; and a metal shell fixed to the base portion and enclosing the tongue plate; wherein a first slope of each first offset section is of one of positive and negative numbers while a second slope of the second offset section is of the rest of the positive and negative numbers.

2. The electrical connector according to claim 1, wherein all the first slopes of the first offset sections are different and gradually decrease in turn along a transverse direction from the second offset section to the first offset section.

3. The electrical connector according to claim 1, wherein the set of first contacts comprise a plurality of second offset sections which gradually decrease in turn along a transverse direction from the first offset section to the second offset section.

4. The electrical connector according to claim 2, wherein each first contact with the first bending section comprises a first vertical section connecting the first offset section and the first contacting section under a condition that the first tail section is parallel to the first vertical section, and wherein height of all the first vertical sections gradually becomes short in turn along the transverse direction.

5. The electrical connector according to claim 1, wherein the tongue plate defines a plurality of second passageways on a second surface opposite to the first passageways, the electrical connector further comprising a set of second contacts comprising second contacting sections received in the second passageways, second bending sections downwardly extending from the second contacting sections, and second tail sections extending from the second bending sections, and wherein the second contacting sections are arranged in another single row and are distributed evenly over the second surface, the second bending sections including a plurality of third offset sections and at least one fourth offset section, a third slope of each third offset section and a fourth slope of the fourth offset section being of negative number and positive number, respectively, from a rear view; and wherein a space between each adjacent two second tail sections is much larger than that of the corresponding second contacting sections.

6. The electrical connector according to claim 5, wherein the third offset sections are gradually decreasing in turn along a transverse direction from the fourth offset section to the third offset section, each third contact having the third offset section comprising a third vertical section connecting the third offset section and the second contacting section, and wherein height of the third vertical sections gradually becomes short in turn along the transverse direction.

7. The electrical connector according to claim 6, wherein the first and the second tail sections are respectively arranged in parallel first and second rows, any first tail section of the first row and any second tail section of the second row being offset from each other along a longitudinal direction perpendicular to the transverse direction.

8. The electrical connector according to claim 5, wherein the tongue plate is reverse U-shaped and comprises a horizontal main portion with the first and the second passageways defined therein and a pair of first and second vertical tabs extending downwardly from lateral sides of the main portion for preventing error insertion of other connectors.

9. An electrical connector defining a receiving space for accommodating a corresponding connector, comprising:

an insulative housing having a tongue plate protruding into the receiving space and a plurality of first passageways defined on a first surface of the tongue plate; and a set of first contacts with first contacting sections received in the first passageways, first bending sections downwardly extending from the first contacting sections and first tail sections extending from the first bending sections, the first contacting sections being arranged in a single row and being exposed essentially evenly to the receiving space; wherein the first contacts comprises an alignment contact with its first contacting section in alignment with its first tail section which extends beyond the insulative housing, and the rest of the first contacts have their first contacting sections offset from their corresponding first tail sections; and wherein a pitch between each adjacent two first tail sections is much larger than that of the corresponding first contacting sections.

10. The electrical connector according to claim 9, wherein the first bending sections comprise a plurality of first offset sections and at least one second offset section located at right and left sides of the alignment contact, respectively, and wherein first slopes of the first offset sections are of negative numbers while a second slope of the second offset section is of positive number.

11. The electrical connector according to claim 10, wherein the first slopes of the first offset sections are gradually decreasing in turn along a left-to-right direction.

12. The electrical connector according to claim 10, wherein the first contacts are located at the right side of the alignment contact and each comprises a first vertical section connecting the first offset section and the first contacting section, and wherein height of the first vertical sections gradually becomes short in turn along a left-to-right direction.

13. The electrical connector according to claim 9, wherein the tongue plate defines a plurality of second passageways on a second surface opposite to the first passageways, the electrical connector further comprising a set of second contacts having second contacting sections received in the second passageways, second bending sections downwardly extending from the second contacting sections, and second tail sections extending from the second bending sections, the second contacting sections being arranged in another single row and being distributed evenly over the second surface; and wherein only one of the second contacts has its second contacting section in alignment with its second tail section, and the rest of the second contacts have their second contacting sections offset from their corresponding second tail sections.

14. The electrical connector according to claim 13, wherein a pitch between each adjacent two second tail sections is much larger than that of the corresponding second contacting sections, and the second bending sections comprise a plurality of third offset sections of different slopes.

15. The electrical connector according to claim 14, the first and the second tail sections are respectively arranged in parallel first and second rows, any first tail section of the first row and any second tail section of the second row being offset from each other along a front-to-rear direction.

16. An electrical connector comprising:

an insulative housing defining a first transverse dimension thereof, along a transverse direction, with a forwardly extending mating tongue with thereof a second transverse dimension, along said transverse direction, being smaller than the first transverse dimension;

one row of contacts disposed in the housing with contacting sections exposed upon the mating tongue, and mounting tails exposed outside of a rear portion of the housing;

a metallic shell surrounding the housing and defining a receiving cavity to receive said mating tongue therein and further defining a chamfered corner facing said mating tongue under condition that said metallic shell defines a third transverse dimension, along said transverse direction, being little larger than the first transverse dimension, and a first vertical center line of the mating tongue is offset from a second vertical center line of the receiving cavity and away from said chamfered corner;

said contacting sections being essentially evenly distributed on a first surface of the mating tongue with a first pitch defined between every adjacent two contacting sections;

the mounting tails essentially evenly distributed in the rear portion of the housing with a second pitch defined between every adjacent two mounting tails and being larger than the first pitch; wherein the mounting tails are arranged in a first area, along said transverse direction, defining thereof a third vertical center line which is essentially equal to and aligned with a fourth center line of the housing and with a second vertical center line of the receiving cavity, while the contacting sections are arranged in a second area, along said transverse direction, defining a fifth vertical center line which is essentially equal to and aligned with the first vertical center line of the mating tongue but offset from the second vertical center line of the receiving cavity and away from the chamfered corner.

17. The electrical connector as claimed in claim 16, wherein said shell includes opposite top and bottom plates and a pair of opposite side walls commonly defining said receiving cavity, and the first area is equally spaced from said pair of opposite side walls in said transverse direction while said second area is closer to one of said pair of opposite side walls than to the other in said transverse direction.

18. The electrical connector as claimed in claim 16, wherein only one of said contacts has the corresponding contacting section aligned with the corresponding mounting tail in a front-to-back direction, and the others located by two sides of said one of the contacts have the corresponding mounting tails outwardly offset from the corresponding contacting sections, respectively under condition that the contacting section of said only one of the contacts is located on one side of the second area relative to the fifth vertical center line, and said side is closer to the corresponding side wall which is spaced from the mating tongue closer than the other side wall.

19. The electrical connector as claimed in claim 16, wherein said first area defines a fourth transverse dimension along said transverse direction and said second area defines a fifth transverse dimension along said transverse direction, under condition that the fourth transverse dimension is one and one third of said fourth transverse dimension while being three fourths of said first transverse dimension.

* * * * *